US012588747B2

(12) United States Patent
Dow et al.

(10) Patent No.: US 12,588,747 B2
(45) Date of Patent: Mar. 31, 2026

(54) HOLDER FOR CONTAINER

(71) Applicant: YETI Coolers, LLC, Austin, TX (US)

(72) Inventors: John W. Dow, Austin, TX (US); Derek G. Sullivan, Austin, TX (US)

(73) Assignee: YETI Coolers, LLC, Austin, TX (US)

( * ) Notice: Subject to any disclaimer, the term of this patent is extended or adjusted under 35 U.S.C. 154(b) by 0 days.

(21) Appl. No.: 18/375,835

(22) Filed: Oct. 2, 2023

(65) Prior Publication Data

US 2024/0023697 A1 Jan. 25, 2024

Related U.S. Application Data

(60) Continuation of application No. 17/504,071, filed on Oct. 18, 2021, now Pat. No. 11,812,843, which is a division of application No. 16/678,546, filed on Nov. 8, 2019, now Pat. No. 11,172,752.

(51) Int. Cl.

| | |
|---|---|
| ***A45F 3/02*** | (2006.01) |
| ***A47G 23/02*** | (2006.01) |
| *A45F 5/00* | (2006.01) |

(52) U.S. Cl.

CPC ..... *A45F 3/02* (2013.01); *A47G 23/02* (2013.01); *A45F 5/1583* (2025.01)

(58) Field of Classification Search

CPC ..... A45F 3/02; A45F 5/1583; A45G 23/02
USPC ..... 224/148.4
See application file for complete search history.

(56) References Cited

U.S. PATENT DOCUMENTS

| | | | |
|---|---|---|---|
| 1,012,364 | A | 12/1911 | Kent |
| 1,208,728 | A | 12/1916 | Bartlett |
| 2,974,814 | A | 3/1961 | Parsons et al. |
| 3,285,455 | A | 11/1966 | Pewitt |
| 4,094,351 | A | 6/1978 | Catenaccio |
| 4,163,374 | A | 8/1979 | Moore et al. |
| 4,181,765 | A | 1/1980 | Harmony |
| 4,194,627 | A | 3/1980 | Christensen |

(Continued)

FOREIGN PATENT DOCUMENTS

| | | |
|---|---|---|
| CN | 1347675 A | 5/2002 |
| CN | 301896802 | 5/2012 |

(Continued)

OTHER PUBLICATIONS

Jan. 9, 2024—(AU) Examination Report 2—App. No. 2020380241.

(Continued)

*Primary Examiner* — Peter N Helvey

(74) *Attorney, Agent, or Firm* — Banner & Witcoff, Ltd.

(57) ABSTRACT

A container holder may include an inner liner, an outer shell, and an intermediate layer in between the inner liner and the outer shell. The inner liner may provide an inner wall. And the inner wall may include a cavity for receiving a container. The container holder can define a first portion and a second portion. The first portion may follow a curved profile and the second portion may follow a flat profile such that a cross-section of the container holder follows a D-shape. The second portion may have a series of openings extending through the outer shell to vent the cavity to an outside. A series of loops may cover the series of openings on the second portion and a pair of clips can be mounted to the series of loops. A bottom vent can extend through the base, the intermediate layer, and the inner liner.

31 Claims, 17 Drawing Sheets

(56) References Cited

U.S. PATENT DOCUMENTS 4,197,890 A 4/1980 Simko
4,401,245 A 8/1983 Zills
4,462,444 A 7/1984 Larson
4,540,611 A 9/1985 Henderson
4,620,426 A 11/1986 Pitchford et al.
4,648,525 A 3/1987 Henderson
4,802,602 A 2/1989 Evans et al.
4,871,597 A 10/1989 Hobson
4,925,071 A 5/1990 Fleming et al.
4,974,761 A 12/1990 Luque
5,067,922 A 11/1991 McMahon
5,169,025 A 12/1992 Guo
D335,957 S 6/1993 Cantrell et al.
5,222,656 A 6/1993 Carlson
5,256,131 A 10/1993 Owens et al.
5,259,529 A 11/1993 Coale
5,313,691 A * 5/1994 Hashimoto ..... A44C 5/2052 24/69 J
D347,766 S 6/1994 Kalat
5,320,249 A 6/1994 Strech
5,325,991 A 7/1994 Williams
D349,190 S 8/1994 Wasserman
5,335,809 A 8/1994 Toida et al.
D352,827 S 11/1994 Schildkraut
D353,045 S 12/1994 Chandler
5,407,110 A 4/1995 Marsh, Jr.
5,445,315 A 8/1995 Shelby
D364,539 S 11/1995 Dickey et al.
5,477,999 A 12/1995 Blankenship, Jr.
5,501,382 A 3/1996 Webb
D373,678 S 9/1996 Haigis
5,564,583 A 10/1996 Kelley et al.
D375,624 S 11/1996 Jensen
D378,022 S 2/1997 Chen
5,622,346 A 4/1997 Story, Jr.
D379,119 S 5/1997 Wolfe et al.
5,711,056 A * 1/1998 Taguchi ..... A44C 5/24 24/69 J
5,740,951 A 4/1998 Jack
5,864,289 A 1/1999 Tiemann
5,941,434 A 8/1999 Green
D419,392 S 1/2000 Schlebusch
D419,770 S 2/2000 Mogil
6,019,245 A 2/2000 Foster et al.
6,029,847 A 2/2000 Mahoney, Jr. et al.
6,032,841 A 3/2000 Johnson
6,131,780 A 10/2000 Becker
6,145,169 A * 11/2000 Terzuola ..... A44B 11/005 24/191
6,145,715 A 11/2000 Slonim
6,279,794 B1 8/2001 Miyazaki
6,286,798 B1 9/2001 Chun
6,318,689 B1 11/2001 Rodriguez
6,401,993 B1 6/2002 Andrino
6,513,661 B1 2/2003 Mogil
6,524,288 B1 2/2003 Hadley-Fruit
6,533,150 B1 3/2003 Margo et al.
6,550,271 B2 4/2003 Silbert
D474,887 S 5/2003 Forster
6,655,543 B2 12/2003 Beuke
6,866,172 B2 3/2005 Shackelford
6,907,877 B2 6/2005 Balogh, II
6,986,438 B2 1/2006 Leung
D540,030 S 4/2007 Schnackenberg
D540,031 S 4/2007 Bouchard
7,228,987 B2 6/2007 Jones
D547,618 S 7/2007 Exler
D549,444 S 8/2007 Schnackenberg
D567,595 S 4/2008 Christopher
D581,658 S 12/2008 Leslie
D601,794 S 10/2009 Jarvio
D607,115 S 12/2009 Bellamy-Noseworthy et al.
7,677,407 B2 3/2010 Davis
D625,513 S 10/2010 Carnes et al.
7,897,088 B2 3/2011 Mitchell
8,001,671 B2 8/2011 Mitchell
8,104,636 B2 1/2012 Crain et al.
D655,090 S 3/2012 Puckett et al.
D663,168 S 7/2012 Khan
D666,877 S 9/2012 Khan
D669,654 S 10/2012 Rogerson
8,297,469 B1 10/2012 Alford et al.
D674,185 S 1/2013 Kao
D682,544 S 5/2013 Raich
D688,537 S 8/2013 Napoli
8,622,262 B2 1/2014 Van Art
8,678,229 B1 3/2014 Alford et al.
8,720,739 B2 5/2014 Bollis
8,757,427 B2 6/2014 Hiner
D709,736 S 7/2014 Gooding
D710,654 S 8/2014 Gooding
8,820,367 B2 9/2014 Reyes
8,870,018 B2 10/2014 Cook et al.
8,925,876 B2 1/2015 Rubinstein
9,027,806 B1 5/2015 Gioggia
9,044,113 B2 6/2015 Hargett
D739,683 S 9/2015 Krohn
9,307,854 B2 4/2016 Myers
9,578,954 B2 2/2017 Sellars
D780,442 S 3/2017 Tidwell
9,681,720 B2 6/2017 Davis
D802,294 S 11/2017 Sola et al.
D840,674 S 2/2019 Earhart
D866,952 S 11/2019 Duran
D991,032 S 7/2023 Shi
D1,006,547 S 12/2023 Dow et al.
D1,033,167 S 7/2024 Li
2001/0032867 A1 10/2001 Silbert
2003/0228072 A1 12/2003 Tyberg
2005/0173478 A1 8/2005 Gill et al.
2005/0230405 A1 10/2005 Dix
2006/0011676 A1 1/2006 Willows et al.
2006/0037982 A1 2/2006 Lesser
2006/0101627 A1* 5/2006 Ida ..... A44B 11/26 24/517
2006/0138154 A1 6/2006 Essel
2007/0017924 A1 1/2007 Hundley
2007/0068944 A1 3/2007 McKinney et al.
2007/0108239 A1 5/2007 San Nicholas
2007/0138188 A1 6/2007 Mace et al.
2007/0138217 A1 6/2007 Hranilovich
2007/0170189 A1 7/2007 Carlile
2007/0221693 A1 9/2007 Moore
2007/0257049 A1 11/2007 Tolan
2008/0047986 A1 2/2008 Will et al.
2008/0223887 A1 9/2008 Mills
2008/0251552 A1 10/2008 Bell
2009/0050767 A1 2/2009 Stone et al.
2010/0072234 A1 3/2010 Tymczyna
2011/0303708 A1 12/2011 Dudley et al.
2012/0018465 A1 1/2012 Andrews
2012/0187138 A1 7/2012 Vasquez et al.
2013/0056484 A1 3/2013 Lu et al.
2013/0098954 A1 4/2013 Inglis
2013/0213986 A1 8/2013 Couvelier
2014/0217256 A1 8/2014 Young
2014/0239003 A1 8/2014 Branca, Jr.
2014/0291182 A1 10/2014 Cascio
2014/0339240 A1 11/2014 Moore
2014/0339244 A1 11/2014 Arnold
2015/0021346 A1 1/2015 Cappuccio
2015/0266653 A1 9/2015 Hill
2016/0046430 A1 2/2016 Tractenberg
2016/0316899 A1 11/2016 Gresham
2017/0036844 A1 2/2017 Seiders et al.
2018/0024701 A1 1/2018 Sanches et al.
2018/0162626 A1 6/2018 Munie et al.
2018/0242701 A1 8/2018 Seiders et al.
2021/0137248 A1 5/2021 Dow et al.

FOREIGN PATENT DOCUMENTS

CN 301956070 6/2012
CN 302376419 4/2013

(56) References Cited

FOREIGN PATENT DOCUMENTS

| | | | |
|---|---|---|---|
| CN | 303528642 | | 12/2015 |
| CN | 304189791 | | 6/2017 |
| CN | 108497653 | A | 9/2018 |
| CN | 305043522 | | 2/2019 |
| CN | 305048049 | | 2/2019 |
| EM | 000084348-0001 | | 2/2004 |
| EM | 000084348-0002 | | 2/2004 |
| EM | 001089932-0001 | | 10/2009 |
| EM | 001827528-0001 | | 8/2011 |
| EM | 001975707-0001 | | 1/2012 |
| EM | 002284596-0001 | | 8/2013 |
| EM | 003561273-0001 | | 1/2017 |
| GB | 3017352 | | 7/2004 |
| GB | 3022544 | | 11/2005 |
| GB | 3022545 | | 11/2005 |
| GB | 3022546 | | 11/2005 |
| GB | 2451667 | A | 2/2009 |
| GB | 4015417 | | 5/2010 |
| GB | 5003433 | | 7/2016 |
| GB | 6013971 | | 6/2017 |
| GB | 6029555 | | 3/2018 |
| GB | 6052753 | | 1/2019 |
| JP | D1146218 | | 7/2002 |
| JP | D1290061 | | 12/2006 |
| JP | D1303435 | | 6/2007 |
| JP | D1548152 | | 4/2016 |
| KR | 300889209.0000 | | 1/2017 |
| KR | 300994276.0000 | | 2/2019 |
| KR | 300994277.0000 | | 2/2019 |
| KR | 300994279.0000 | | 2/2019 |
| WO | 05016065 | A1 | 2/2005 |
| WO | D089669-001 | | 3/2016 |
| WO | D102724-001 | | 9/2018 |
| WO | D102724-002 | | 9/2018 |
| WO | D102724-003 | | 9/2018 |
| WO | D102724-004 | | 9/2018 |
| WO | D102724-005 | | 9/2018 |
| WO | D102724-006 | | 9/2018 |
| WO | D102724-007 | | 9/2018 |
| WO | D102724-008 | | 9/2018 |
| WO | D102724-009 | | 9/2018 |
| WO | D102724-010 | | 9/2018 |
| WO | D102724-011 | | 9/2018 |
| WO | D102724-012 | | 9/2018 |
| WO | D102724-013 | | 9/2018 |
| WO | D102724-014 | | 9/2018 |
| WO | D102724-015 | | 9/2018 |

OTHER PUBLICATIONS

Feb. 19, 2021—(WO) International Search Report & Written Opinion—PCT/US20/058700.

Jan. 28, 2022—(MX) Office Action—App. No. MX/f/f2020/001251.

Jun. 2, 2023—(AU) Examination Report No. 1—App. No. 2020380241.

Jul. 13, 2023—(CA) Office Action—App. No. 3159761.

Jan. 27, 2024—(CN) First Office Action—App. No. 202080079612.8.

May 17, 2024—(AU) Examination Report No. 3—App. No. 2020380241.

Jun. 15, 2024—(CN) Decision of Rejection—App. No. 2020800796128.

Dec. 12, 2023—(NZ) Examination Report 1—App. No. 787835.

Sep. 16, 2024—(CA) Second Office Action—App. No. 3159761.

Amazon.com. YETI Bottle Sling for Rambler Bottles, YETI Store. ASIN: B09RN64678. date first available Feb. 1, 2022 (Year: 2022).

Amazon.com. Tainehs Water Bottle Holder, Water Bottle Carrier with Adjustable Shoulder Strap, Beach Bottle Bag, Water Bottle Sling, Dog Water Bottle Sleeve for Sports, Gym, Hiking, Camping, Walking, Travel Essentials. ASIN: B0C6XB2DTP/ date first available Jun. 22, 2022 (Year: 2022).

Jul. 1, 20257—(CA) Third Office Action—App. No. 3159761.

* cited by examiner

HOLDER FOR CONTAINER

CROSS REFERENCE TO RELATED APPLICATION

This application is a continuation of U.S. application Ser. No. 17/504,071 filed on Oct. 18, 2021, which is a divisional of U.S. application Ser. No. 16/678,546 filed Nov. 8, 2019, now U.S. Pat. No. 11,172,752, each of which are incorporated herein by reference for all non-limiting purposes.

BACKGROUND

The below disclosure pertains to portable beverage container holders.

BRIEF SUMMARY

This Summary is provided to introduce a selection of concepts in a simplified form that are further described below in the Detailed Description. The Summary is not intended to identify key features or essential features of the claimed subject matter, nor is it intended to be used to limit the scope of the claimed subject matter.

In certain examples, the below disclosure provides portable beverage container holders, which may be used for carrying a variety of beverage containers. Also in certain examples, the portable beverage container holders can be secured to bags, coolers, and other portable objects.

An example container holder may include an inner liner, an outer shell, and an intermediate layer in between the inner liner and the outer shell. The inner liner may provide an inner wall. The inner wall may define a cavity for receiving a container. The container holder may include a first portion and a second portion where the first portion follows a curved profile, and the second portion follows a flat profile such that a cross-section of the container holder follows a D-shape. A pocket may be located on the outer shell and on the first portion. The second portion may include a series of openings extending through the outer shell to vent the cavity to an outside. The container holder may also include a bottom and the bottom may include an opening for venting the cavity of the container holder.

BRIEF DESCRIPTION OF THE DRAWINGS

The present disclosure is illustrated by way of example and not limited in the accompanying figures in which like reference numerals indicate similar elements and in which.

Further, it is to be understood that the drawings may represent the scale of different components of various examples; however, the disclosed examples are not limited to that particular scale.

DETAILED DESCRIPTION

In the following description of the various examples, reference is made to the accompanying drawings, which form a part hereof, and in which is shown by way of illustration various examples in which aspects of the disclosure may be practiced. It is to be understood that other examples may be utilized and structural and functional modifications may be made without departing from the scope and spirit of the present disclosure. In the following description of the various embodiments, reference is made to the accompanying drawings, which form a part hereof, and in which is shown by way of illustration various embodiments in which aspects may be practiced. Also references to "embodiment," "example," etc., indicate that the embodiment(s) or example(s) of the invention so described may include particular features, structures, or characteristics, but not every embodiment or example necessarily includes the particular features, structures, or characteristics. Further, it is contemplated that certain embodiments or examples may have some, all, or none of the features described for other embodiments. And it is to be understood that other embodiments may be utilized and structural and functional modifications may be made without departing from the scope of the present disclosure.

Also, while the terms "front," "rear," "top," "base," "bottom," "side," "forward," and "rearward" and the like may be used in this specification to describe various example features and elements, these terms are used herein as a matter of convenience, e.g., based on the example orientations shown in the figures and/or the orientations in typical use. Nothing in this specification should be construed as requiring a specific three dimensional or spatial orientation of structures in order to fall within the scope of the claims.

Figure 1:
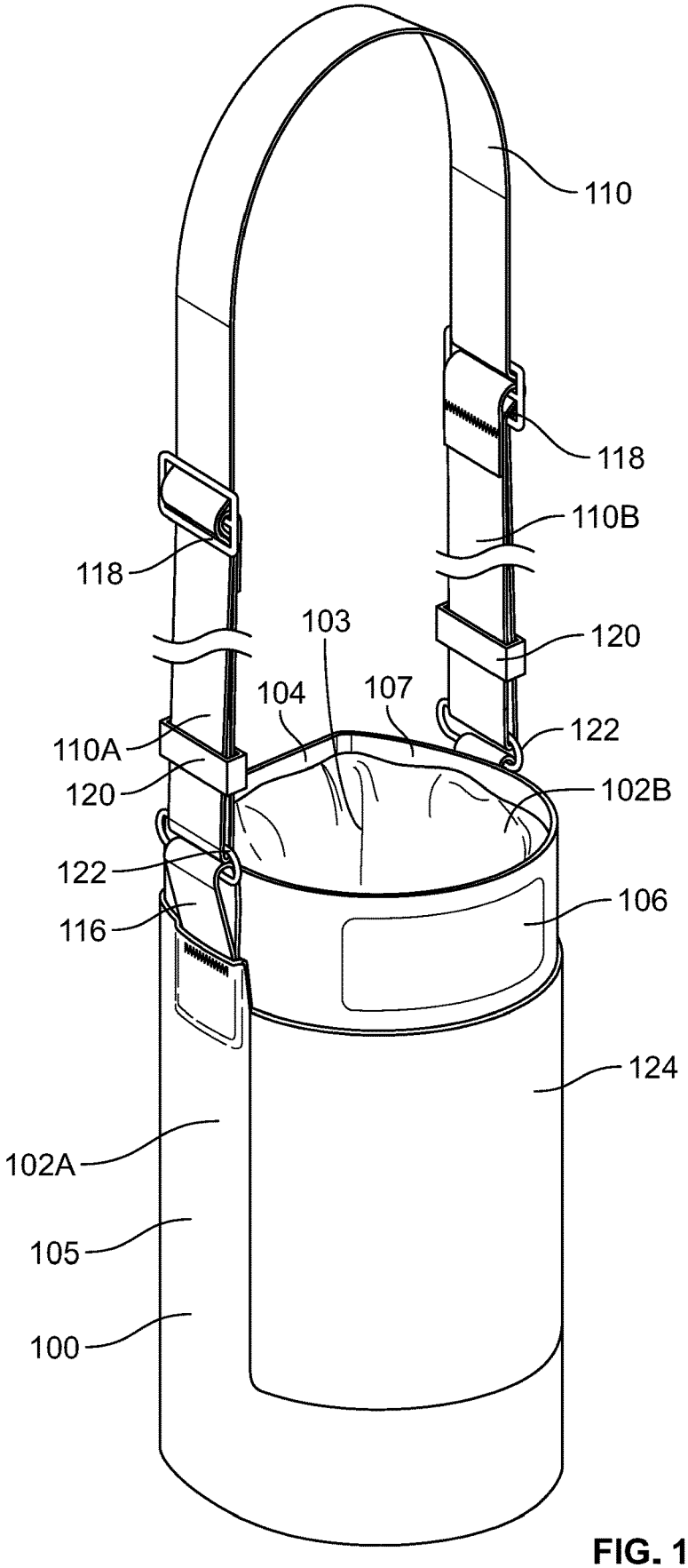
FIG. 1 depicts an isometric view of an example container holder.
Figure 2:
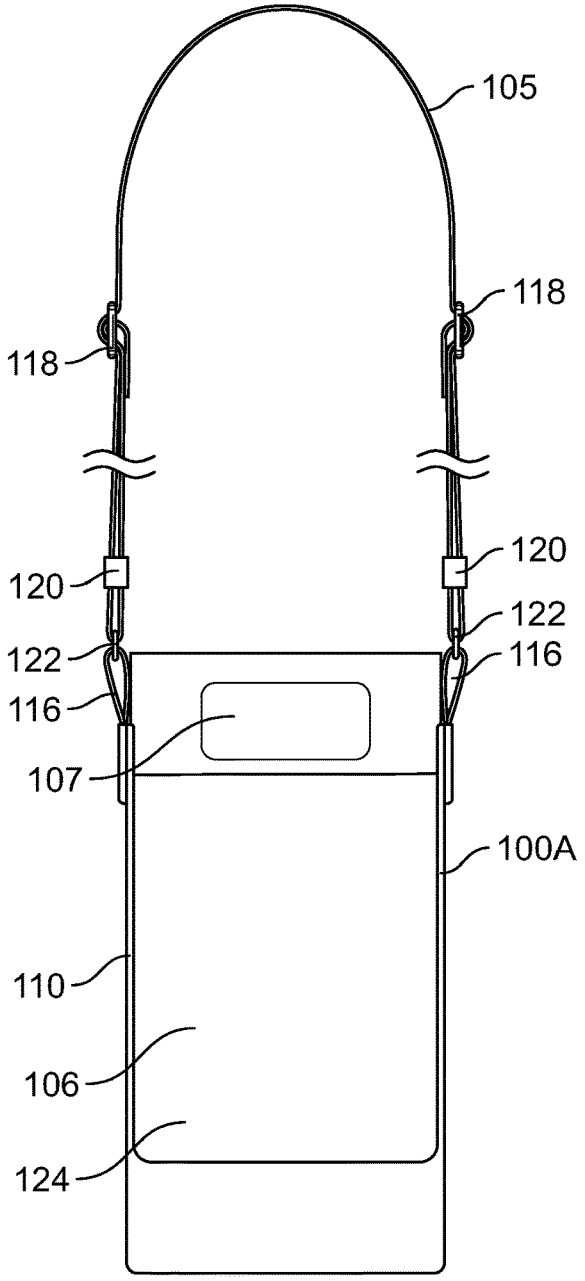
FIG. 2 shows a front view of the example container holder of FIG. 1.
Figure 8:
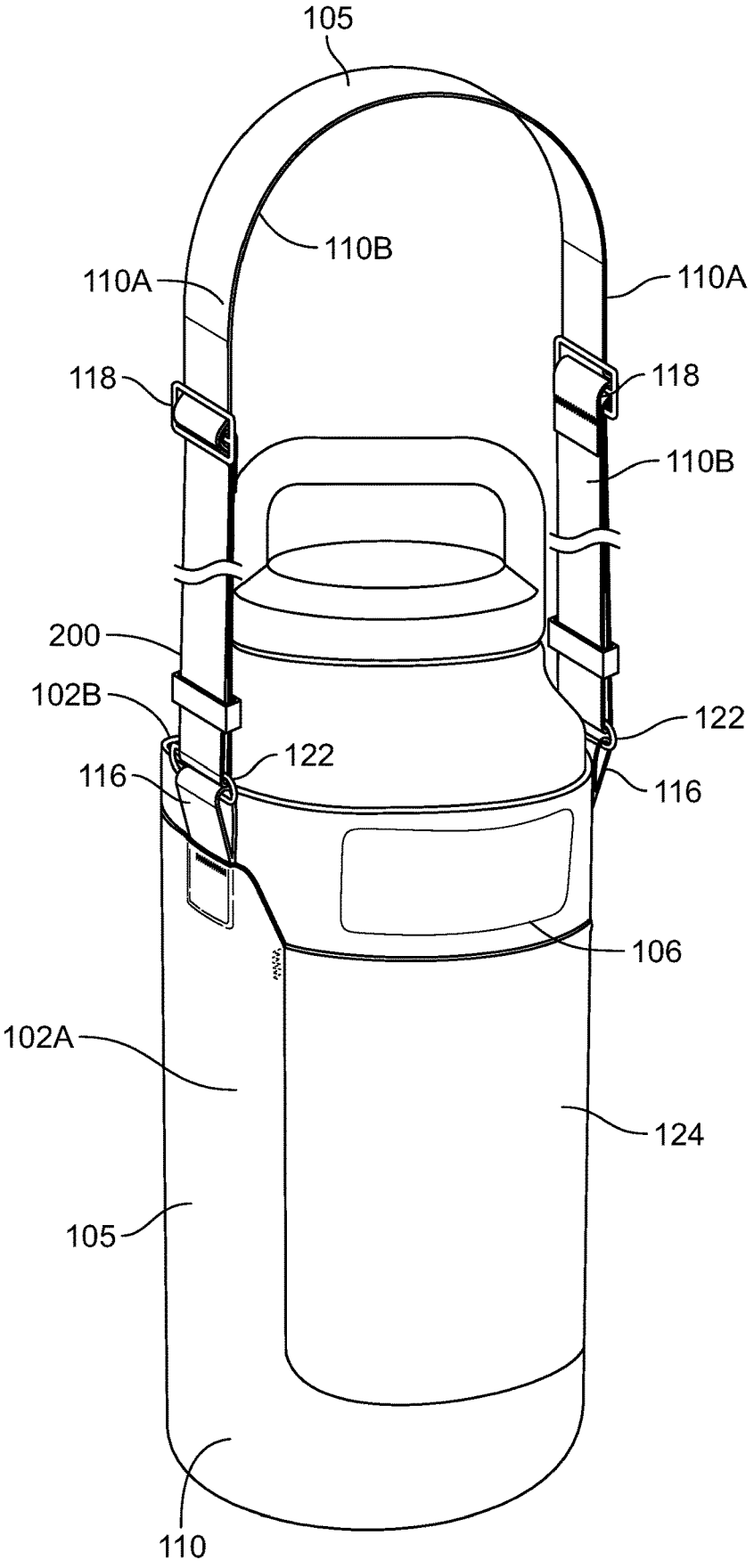
FIG. 8 shows a perspective view of the example container holder of FIG. 1 holding an example container.

FIG. 1 depicts an isometric view of an example container holder 100. The container holder 100 has an outer wall or outer surface 102A formed by an outer shell 110. The container holder may also include and an inner wall or inner surface 102B formed by an inner liner 108. The inner wall or inner surface 102B defines a cavity 103 for receiving a container 200, as is shown in FIG. 8. The container holder 100 can be formed of two portions or sections, a first portion or a front portion 106 and a second portion or rear portion 104. As will be discussed below, in some examples the overall thickness of the wall of the second portion 104 may be formed larger than the first portion 106 to accommodate different sized containers.

In one example, an outer shell 110 of the container holder 100 can be formed of a TPU (thermoplastic polyurethane) coated fabric. And an inner liner 108 of the container can be formed of a stretch fabric. And in one example, the inner liner 108 can be formed of a breathable fabric so that a certain degree of venting of air may occur within the cavity so a container can be easily placed in or removed from the container holder 100. An intermediate layer 111, which in certain examples may be a foam material, can be placed in between the outer wall 102A and the inner wall 102B in both the first portion and the second portion areas.

Figure 6:
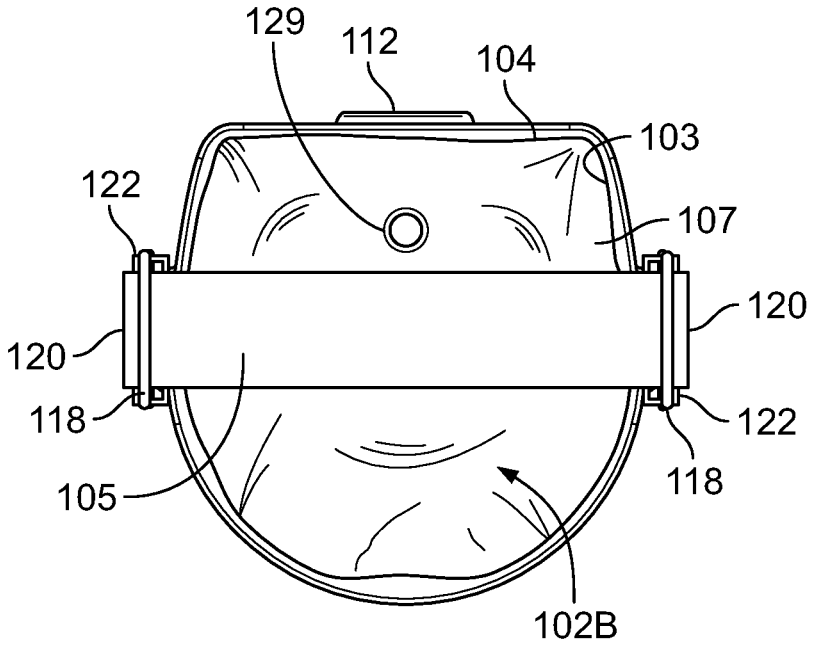
FIG. 6 shows a top view of the example container holder of FIG. 1.
Figure 7:
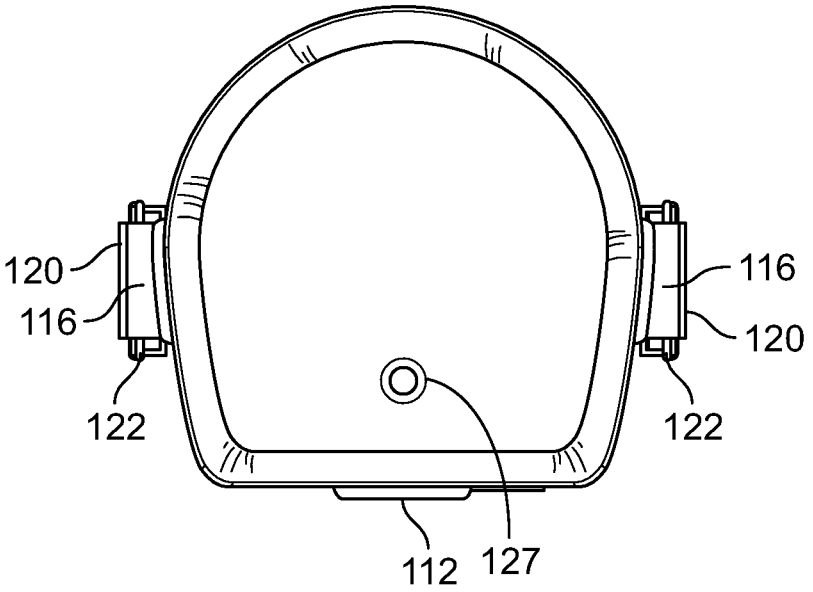
FIG. 7 shows a bottom view of the example container holder of FIG. 1.

As is shown in FIGS. 1-8, the first portion 106 can follow a curved profile and the second portion 104 can follow a flat profile to provide a curved side 100A and a flat side 100B. And as is shown in FIGS. 6 and 7, a cross-section of the container holder can follow a D-shape or a horse-shoe shape. In the example container holder 100, the flat side 100B helps to stabilize the container holder 100 onto a surface, such as a cooler face, and also offers a secure base to mount attachment hardware.

Figure 9:
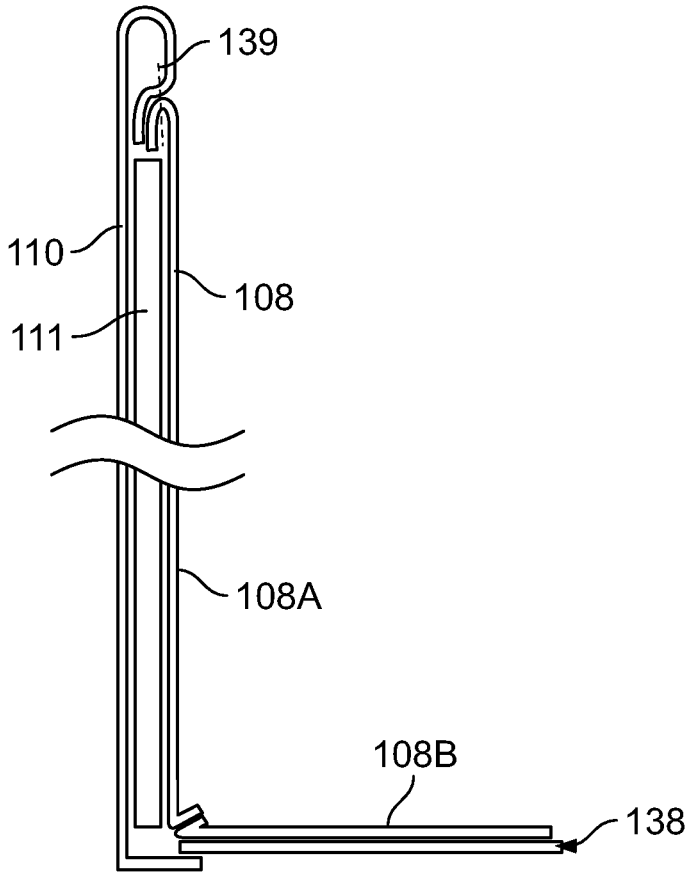
FIG. 9 shows an exemplary partial cross-sectional schematic view of the container holder of FIG. 1.

Referring now to FIG. 9, which shows a schematic of a cross-section, the container holder 100 can include an inner liner 108, an outer shell 110, and an intermediate layer 111 in between the inner liner 108 and the outer shell 110. In one example, the intermediate layer 111 can be a foam material. And in one example, the foam located in the first portion and the second portion can be a closed or an opened cell foam material. Also in this example, the intermediate layer can be optional at the base 138 and is not depicted schematically at the base 138.

The front portion 106 of the of the container holder 100 can include a pocket 124 for storing items. The front portion 106 can also include a logo that is formed of TPU and welded onto the container holder 100. In another example, the front portion can include a heat transfer logo 107. Also, a carry strap 105 can be included on the container holder 100 and may be used by the user to carry the container holder 100. In one example, loops 112 can be included on the rear portion of the container holder 100 for holding items and/or securing the container holder 100 to surfaces or objects.

The example container holder 100 can include a pair of side loops 116 for receiving a carry strap or sling 105. The carry strap or sling 105 for carrying the container holder 100 is shown in detail in FIGS. 11A-11C and can be included so the user can either hand carry the container holder 100 or carry the container holder 100 over the shoulder. The carry strap 105 can be configured to be adjustable to accommodate different sized users by providing a pair of slip locks or tri-glides 118. In one example, the strap 105 can be made of a single piece of variable width webbing ranging from 25 mm to 38 mm.

Figure 11A:
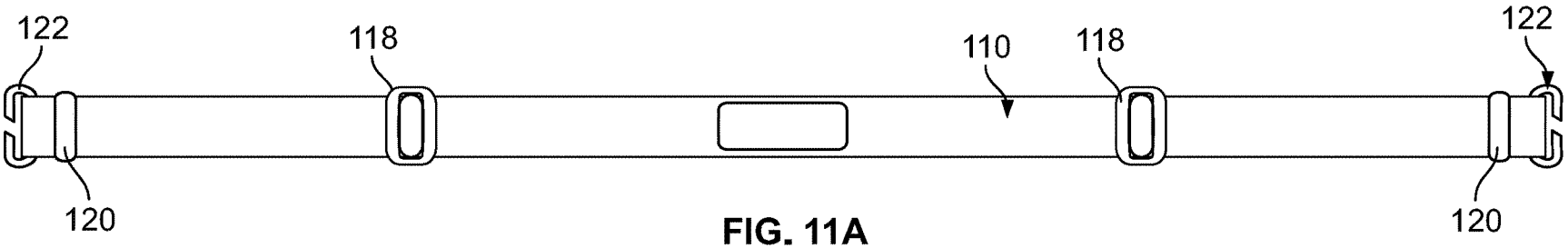
FIG. 11A shows a top view of an example carry strap that can be used with the example container holder of FIG. 1.
Figure 11B:
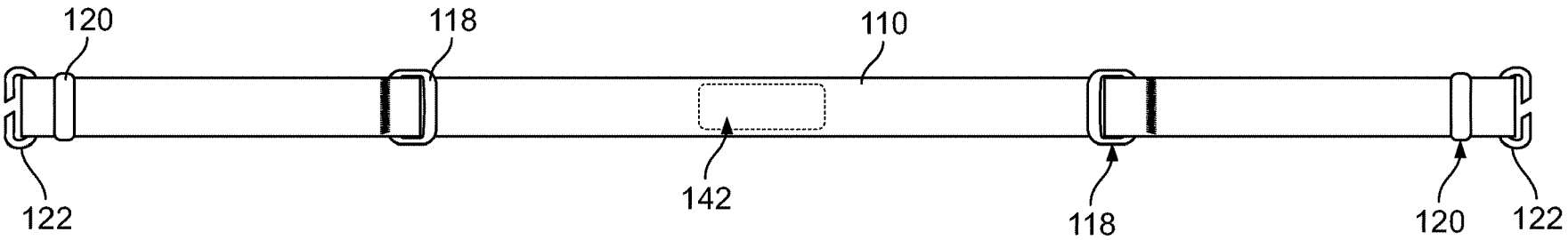
FIG. 11B shows a bottom view of an example carry strap that can be used with the example container holder of FIG. 1.
Figure 11C:
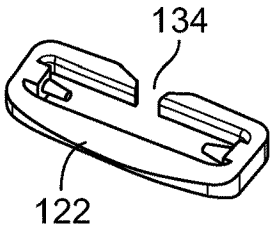
FIG. 11C shows an example loop that can be used in conjunction with the carry strap of FIGS. 11A and 11B.

Referring to FIGS. 11A and 11B, the slip locks 118 allow the user to resize the carry strap 105. For example, the carry strap 105 can double back on itself in two areas 105A and 105B through the use of the slip locks 118. And the user can position the slip locks 118 along the strap 105 to change the overall length of the strap 105. Also a pair of strap keepers 120 can be included to maintain the carry strap 105 in a vertical orientation and to prevent tangling of the carry strap 105. A pair of rigid loops 122 may also be provided to secure the ends of the carry strap 105 to the container holder 100. As shown in FIG. 11C, in one example the rigid loops 122 can include a slot or an opening 134 to form a split loop such that rigid loops 122 are releasably engaged with the side loops 116. In this way, the strap 105 may be removable from the container holder 100.

The carry strap 105 may also include a grip portion or grip patch 142, as shown in FIG. 11B. The grip can be provided so that the carry strap 105 does not slide off of the user's shoulder when carried. The grip patch 142 can be screen printed to the rear portion of the strap 105, and can be arranged in a honey comb configuration. However, other patterns and configurations are also contemplated that would provide a suitable gripping force on the user's shoulder.

Figure 3:
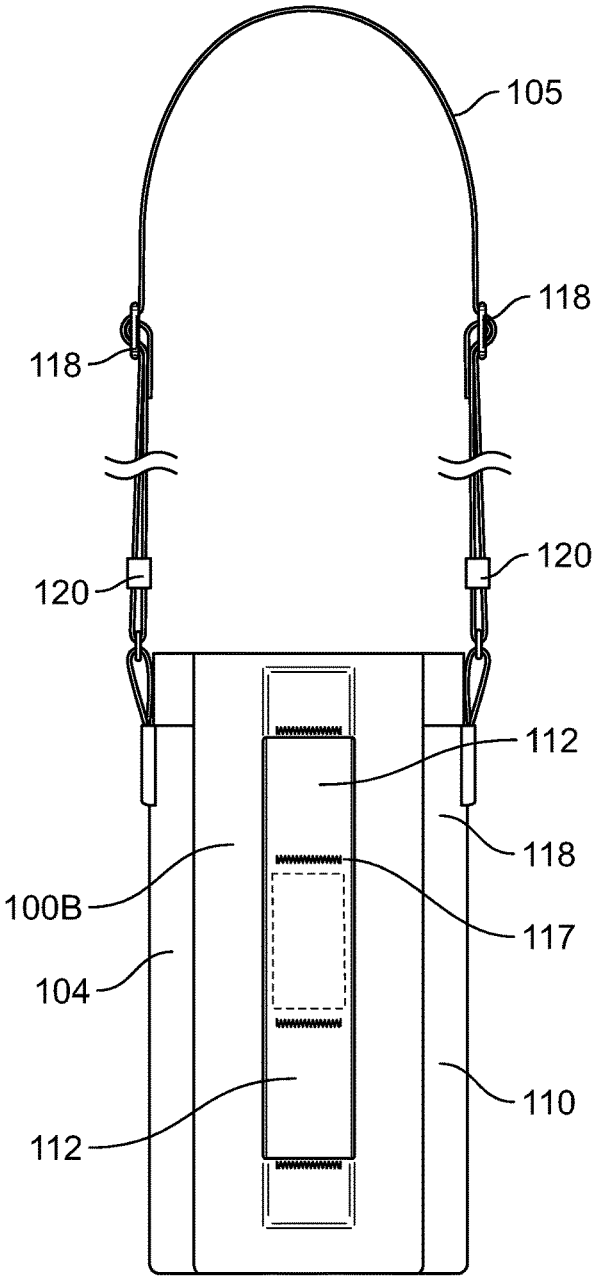
FIG. 3 shows a rear view of the example container holder of FIG. 1.

Also as shown in FIG. 3, the container holder 100 can include a series of loops 112 on the rear side or flat side 100B of the container. Together the loops 112 can form Hitch-point™ Grid mounting hardware. In one example the loops 112 can be MOLLE (Modular Lightweight Load-carrying Equipment) loops and can have a degree of durability. The loops 112 can be used for attaching various items to the container holder 100, for example, hooks, ropes, keys, carabiners, etc.

Figure 14B:
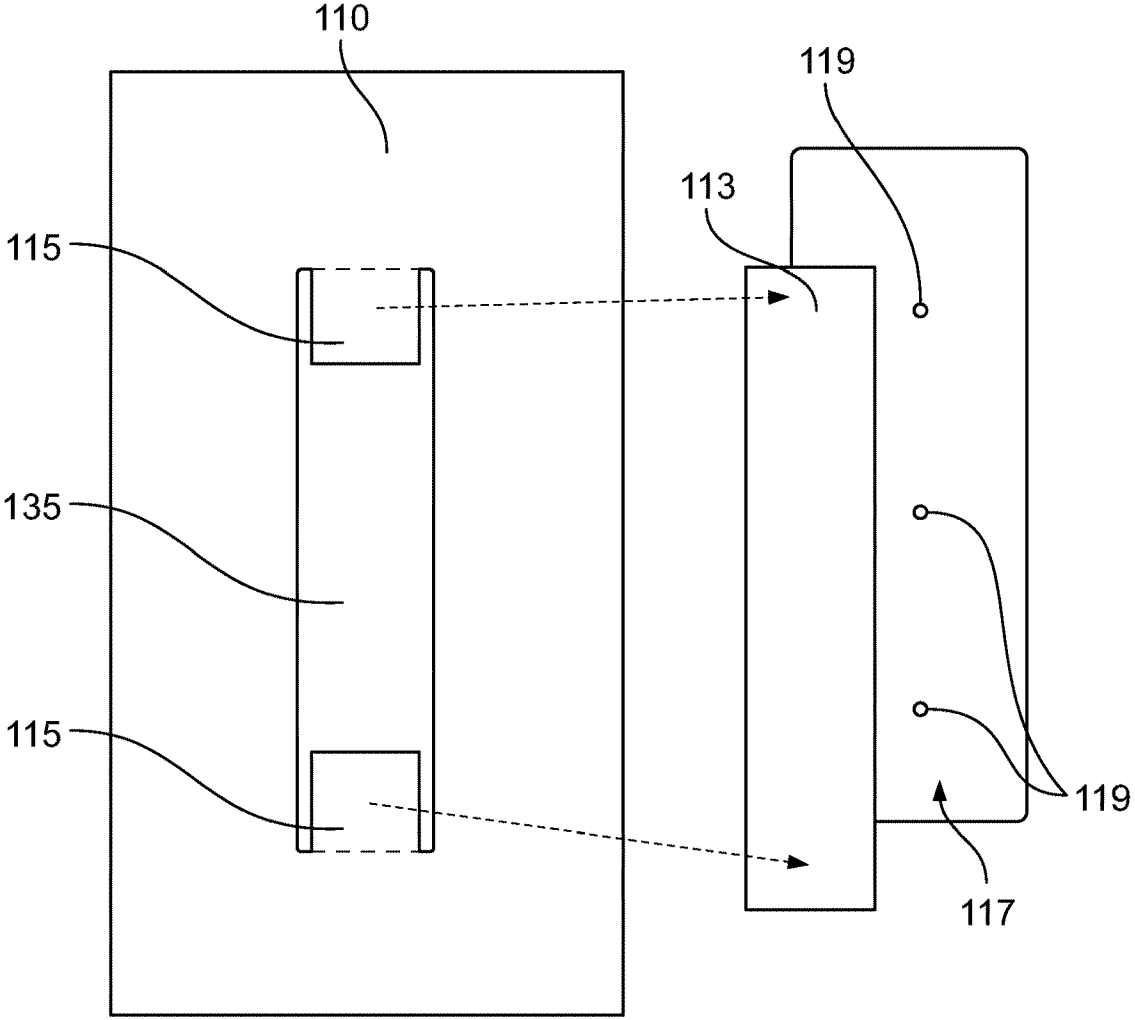
FIG. 14B depicts an assembly method of attaching the webbing of 14A to a container holder.
Figure 14A:
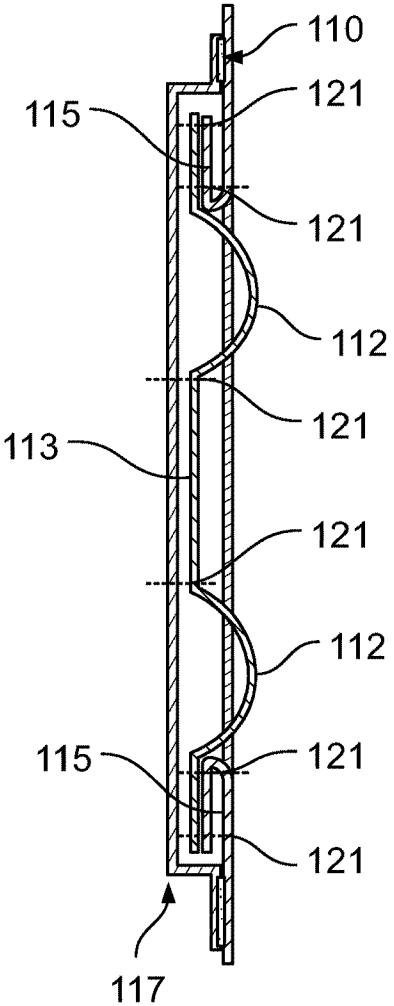
FIG. 14A shows a schematic of an example webbing that can be included on the example container holder of FIG. 1.
Figure 14C:
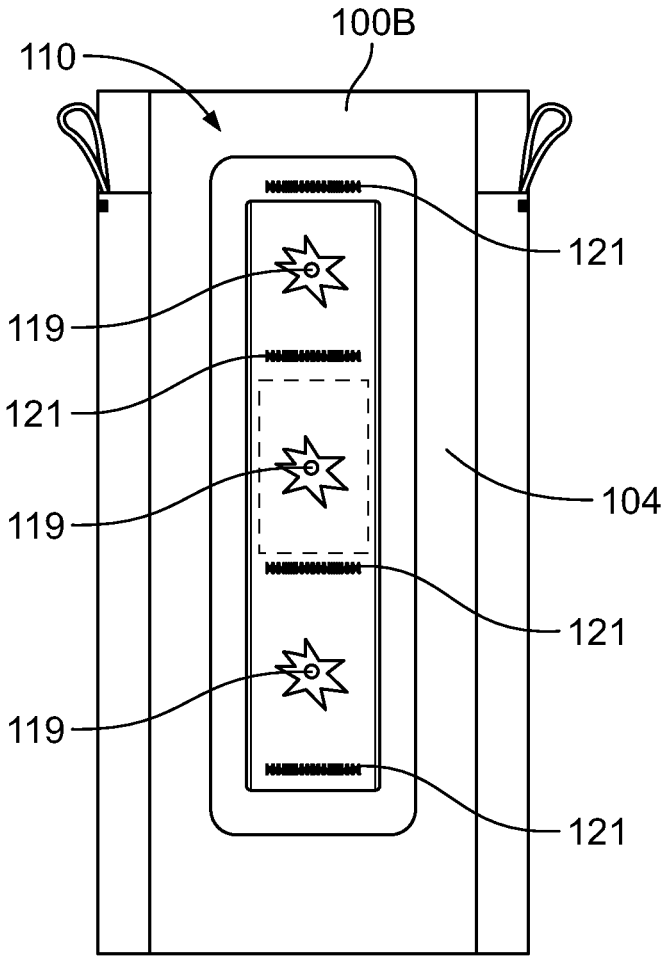
FIG. 14C shows a schematic of the example webbing of FIG. 14A secured to a container holder.

FIGS. 14A-14C illustrate an example loop arrangement and manufacturing method in more detail. The loop arrangement can be formed of a strip of material 113, which can be a webbing or fabric material. The strip 113 can be located on and attached to a pair of tabs 115 located on the outer shell 110 at the second portion 104 of the container holder 100. And a reinforcement layer 117 can be placed behind the strip 113 forming the loops 112. In one example, the strip 113 can be used to form the loops 112 by adding a series of stitching 121, which in one example can be a bar-tack or lock stitch type of stitch.

As shown in FIG. 14B, the tabs 115 extend from an opening 135 in outer shell 110 at the second portion 104. And the strip 113 can be sewn onto the separate tabs 115 that extend from a portion that forms the outer shell 110. The tabs 115 can then be folded over and sewn onto the outer shell 110 at the second portion 104 as is illustrated in FIG. 14A to add additional reinforcement. The reinforcement layer 117 can then be heat welded onto the outer shell 110 adjacent to the strip 113 to cover the opening 135. After the reinforcement layer 117 is added onto the outer shell 110, stitching 121 can be added to form the loops 112 onto the strip 113.

It is also contemplated that a more rigid layer (not shown) can be added internally in the area of the strip 113. This more rigid layer provides a stiff structure for when the container holder 100 is mounted to a separate object, such as a bag or cooler. The more rigid layer can be formed of a Polyethylene (PE) board or any material with like properties. And in one example, the more rigid layer can extend internally within the entire second portion 104 or the flat side 100B of the container holder 101. In one example, the more rigid layer can be placed between the outer shell and the intermediate layer.

Also as illustrated in FIG. 14B and schematically in FIG. 14C, the reinforcement layer 117 can be provided with a series of venting holes 119. The venting holes can allow fluid to escape from within the container. For example, the series of venting holes 119 allows air within the cavity 103 to escape and reduces the amount of suction within the container holder, such that a container can be easily placed in and removed from the internal cavity 103 of the container holder 100 by the user. In another example, the series of holes can allow liquid trapped within the container holder 100 to drain out of the container holder 100. In this example the venting holes 119 only extend through the outer shell 110 and not through the intermediate layer 111 or the inner liner 108. But as discussed herein in relation to FIGS. 15A-15C, the seam 125 forming the intermediate layer can be stitched with a slight gap between the edges of the material forming the intermediate layer 111 to allow for the venting of air through the outer shell 110 at the venting holes 119. Also the inner liner 108 can be formed of a breathable fabric so venting of the internal cavity 103 can occur. Also in this example, the holes 119 can be hidden from view by being placed underneath the loops 112. This is not readily noticeable and provides a clean look of the container holder 100 to the consumer.

Figure 3A:
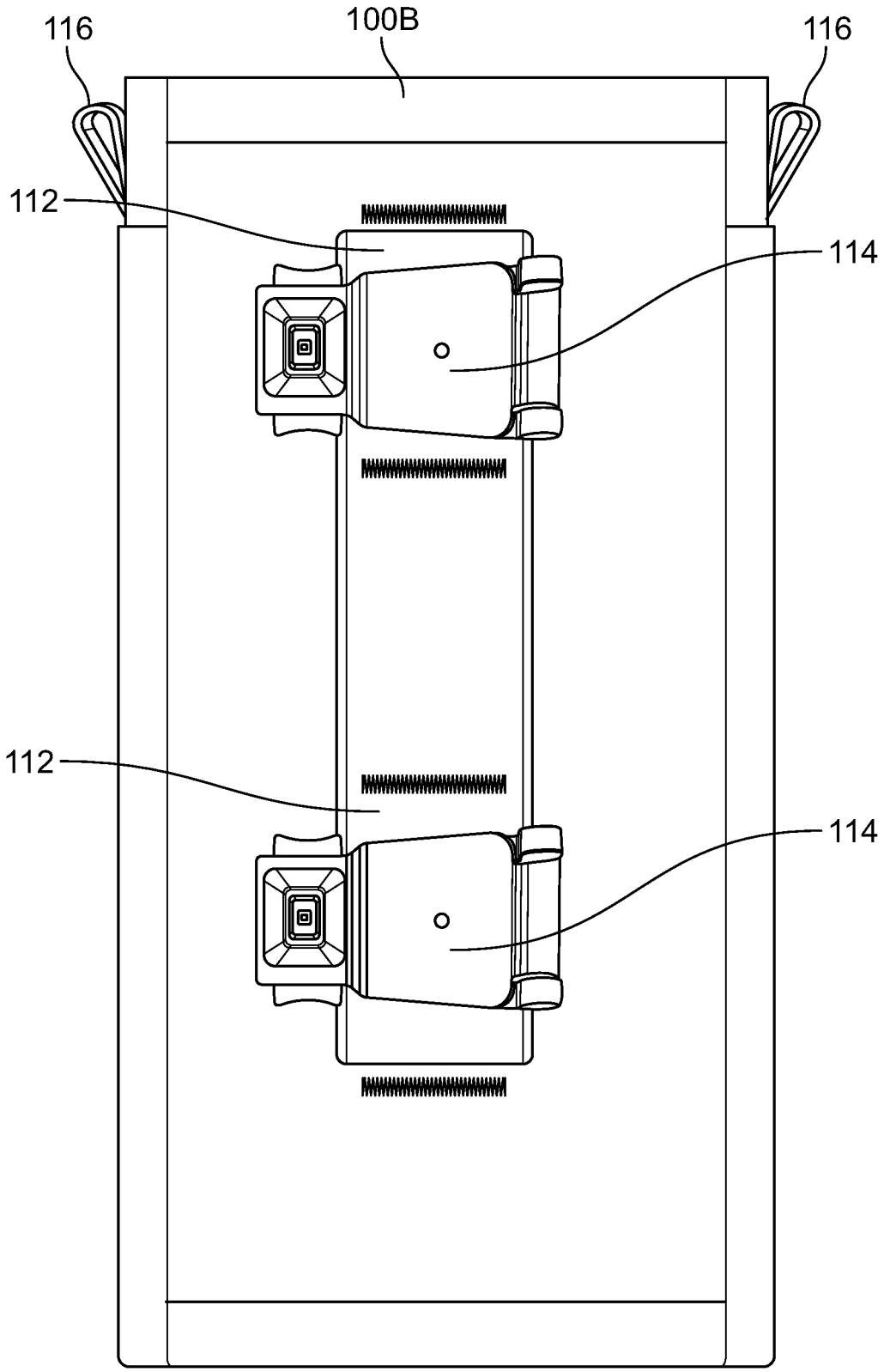
FIG. 3A shows a rear view of the example container holder of FIG. 1 with optional clips.

In addition to concealing the venting holes 119 located behind each loop 112, in one example, as is shown in FIG. 3A, the loops 112 can be configured to receive a series of clips or locks 114. The clips or locks 114 can be configured to secure the container holder 100 onto a strap or other surface located on a bag, cooler, etc. at the container holder's rear surface. For example, the bag, cooler, or other structure may also include a series of loops or MOLLE loops for receiving the series of clips or loops 112 on the container holder 100.

Figure 3B:
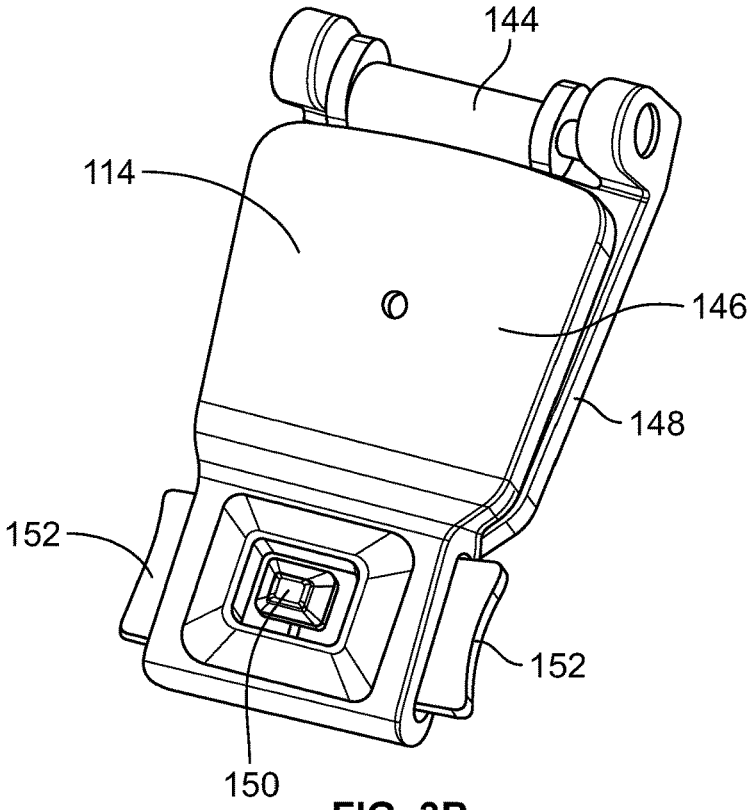
FIG. 3B shoes a perspective view of an example clip in a first closed position.
Figure 3C:
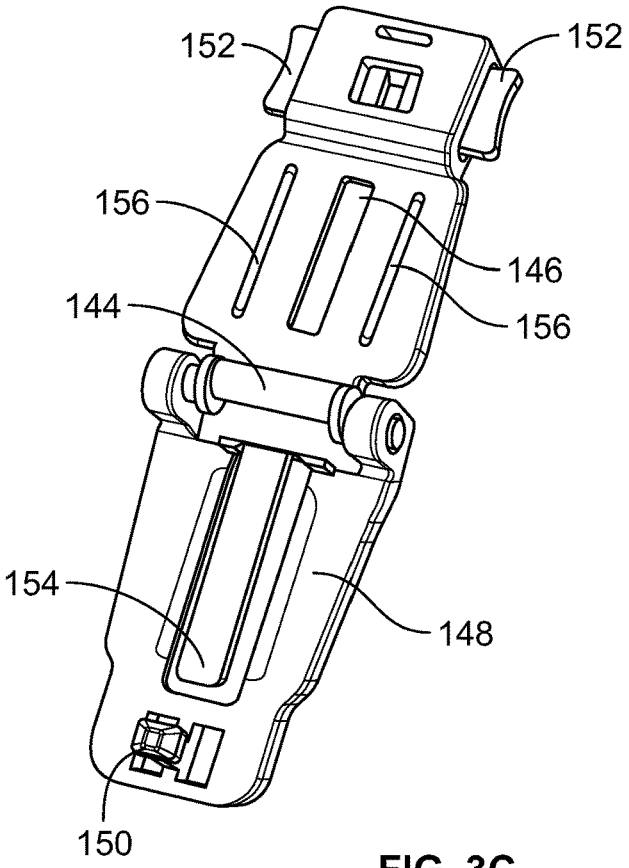
FIG. 3C shows a perspective view of the example clip of FIG. 3B in a second opened configuration.
Figure 4:
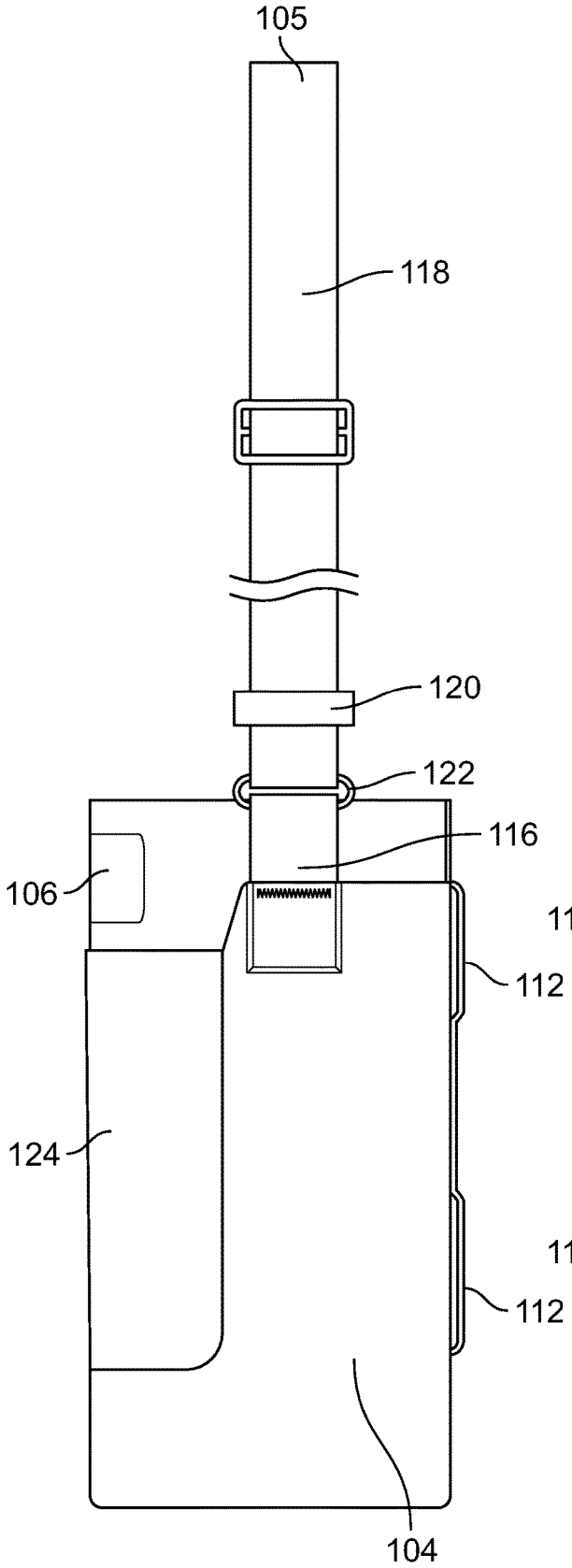
FIG. 4 shows a right-side view of the example container holder of FIG. 1.
Figure 5:
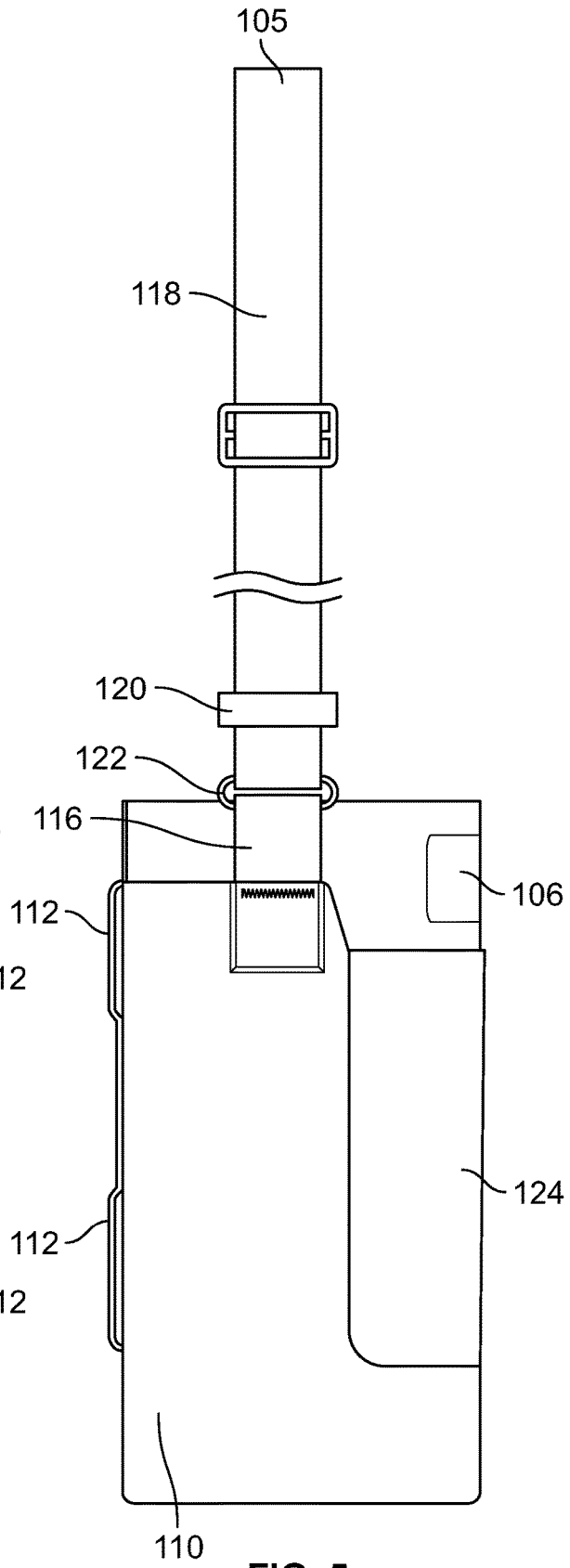
FIG. 5 shows a left-side view of the example container holder of FIG. 1.

In one example the clips 114 can be heavy duty slip locks, which are shown and described in relation to FIGS. 3A-3B. The slip locks 114 can be configured to open and close on the loops 112 and straps or loops located on another object such as a softsided cooler or bag. In this way, the container holder 100 can be secured or mounted to another object while holding a container 200. The slip locks 114 can include a hinge 144, to rotate a clamping plate 146 relative to the slip lock base 148. The clamping plate 146 is configured to hold a loop 112 of the container holder 100 and a strap of another object, such as a bag or cooler, against the slip lock base 148. In this way, the container holder 100 can be secured to the strap of the other object. The slip lock base 148 may also include a clamping projection 150. The clamping projection 150 can be releasably held between two spring-loaded arms or flanges 152 to retain the clamping plate 146 in the closed position. The slip lock base 148 can be held onto a loop of the container holder 100 with an underlying spring loaded clip 154. And the user may actuate the spring-loaded arms or flanges 152 to release the clamping plate 146 from the closed position against the slip lock base 148. Also the clamping plate 146 can include a pair of elongated projections 156, which act as retention mechanisms to maintain the slip lock 114 at the correct position along the strap of the object to which the container holder 100 is being attached.

Figure 12A:
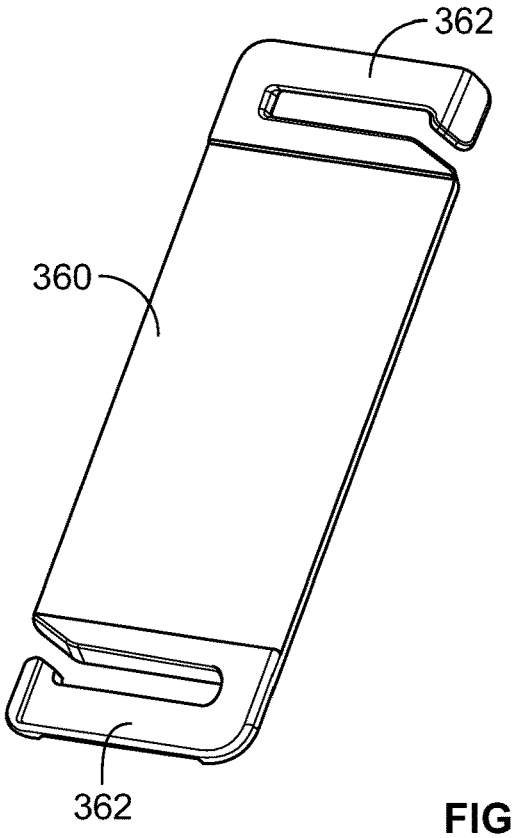
FIG. 12A shows an example attachment method that can be used in conjunction with the container holders described herein.
Figure 12B:
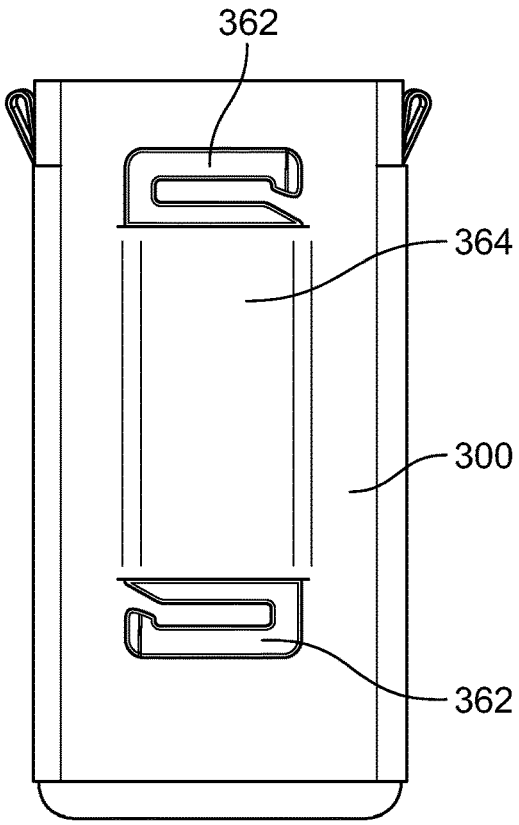
FIG. 12B shows the example attachment method of FIG. 12A assembled to an example container holder.

FIGS. 12A-13B show other examples of methods for attaching the container holder to straps. FIGS. 12A and 12B show a hook-type of securing method example for securing the container holder 300 to an object or straps such as straps located on a bag or a cooler. In this example, a plate 360 can be provided with hook ends 362. And instead of using loops as discussed above, the container holder 300 can include a slot 364 for receiving the plate 360. The hook ends 362 are configured to secure to straps or loops located on an object such as a bag or cooler. And in one example, the loops located on the object, bag, or cooler can be MOLLE loops. For example, the hook ends 362 can be hooked onto the strap and thus the plate 360, so the container holder 300 is held onto the straps. In one example, the hook ends 362 can be provided with a spacing that allows the upper hook end to be placed in an upper loop or strap and a lower hook end that can be placed into a lower strap in such a way that both hook ends 362 are placed into a loop or strap located on the object. In one example, the plate 360 can be configured to be entirely removable from the slot 364. In this way, once the plate 360 is removed from the slot 364, the container holder 300 can be better suited for carrying with the carry strap only.

Figure 13A:
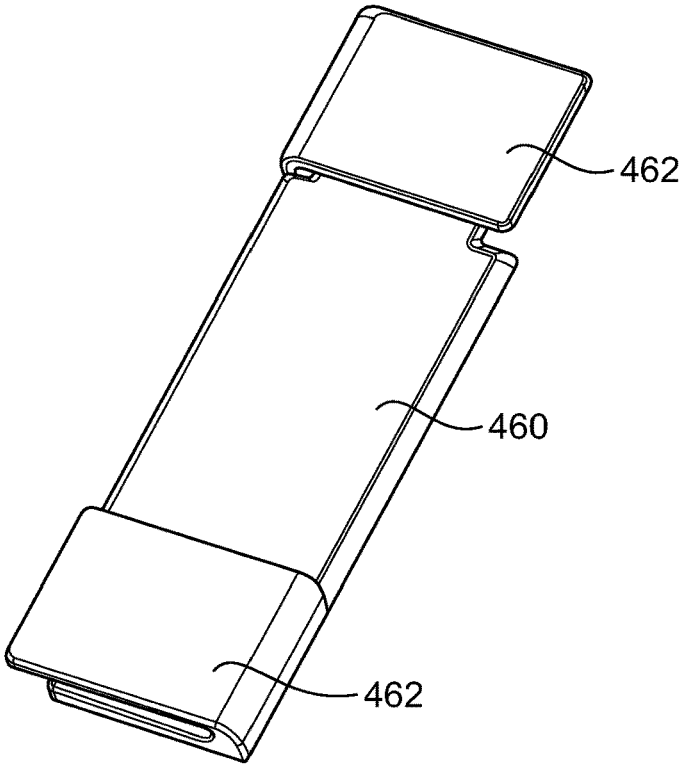
FIG. 13A shows another example attachment method that can be used in conjunction with the container holders described herein.
Figure 13B:
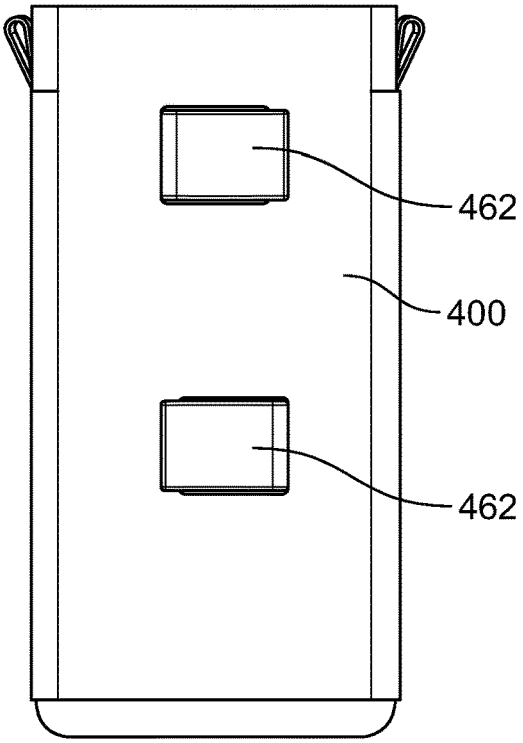
FIG. 13B shows the example attachment method of FIG. 13A assembled to an example container holder.

FIGS. 13A and 13B show another example method for securing a container holder 400 to straps. In this example, the plate 460 is provided with ends having U-shaped slots 462. Similar to the above example, the U-shaped slots 462 are configured to secure to straps or loops located on an object such as a bag or cooler. In this way, the user lines up the U-shaped slots with the straps or loops located on an object and the container holder 400 is secured to the object. And in one example, the loops can be MOLLE loops. For example, the hook ends 462 can be hooked onto the strap and thus the plate 460, so the container holder 400 is held onto the straps or loops of the object. In one example, the hook ends 462 can be provided with a spacing that allows the upper U-shaped end to be placed in an upper loop or strap and a lower U-shaped end that can be placed into a lower strap in such a way that both U-shaped ends 462 are placed into a loop or strap located on the object.

In one example, referring to FIG. 1 again, the first portion 106 may also include the pocket 124 formed of a stretch woven material. The pocket 124 can configured as a flat accessory pocket, which in one example can be intended to receive and carry various items such as smart phones, keys, credit cards, IDs, etc. In one example, the stretch woven material of the pocket 124 can expand to receive various items. The stretch woven material may also provide durability to the pocket 124.

Figure 10B:
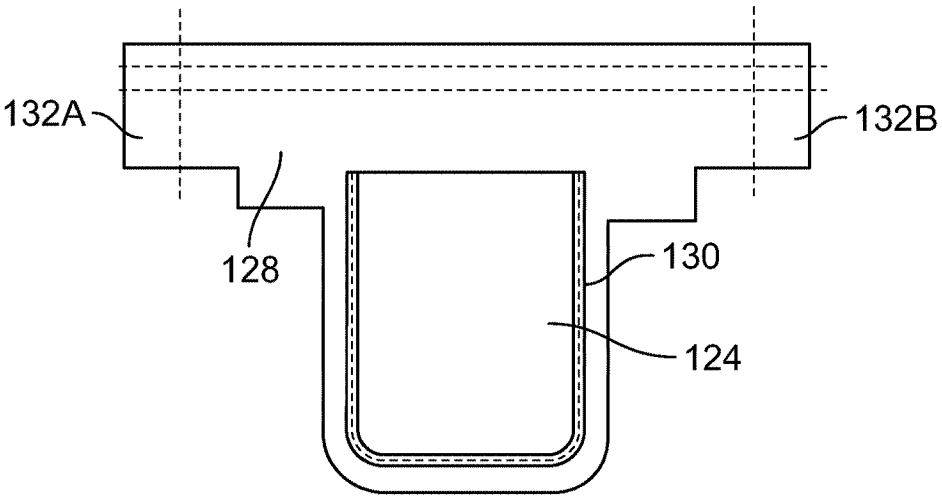
FIG. 10B shows a front view of example pocket assembly for the example container holder of FIG. 1.
Figure 10A:
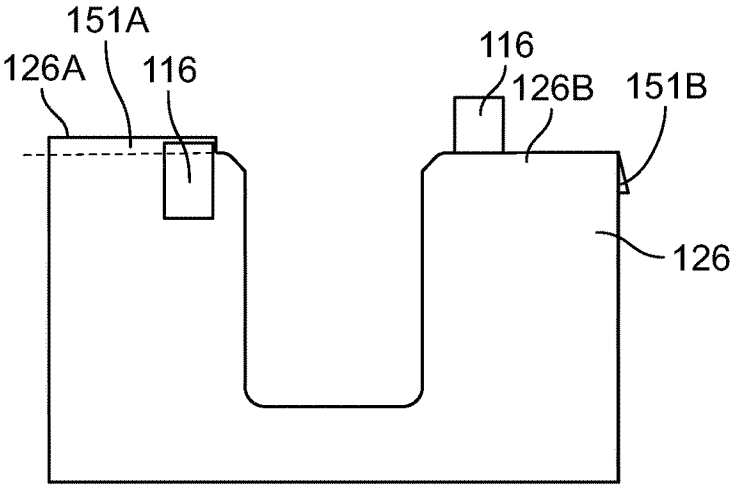
FIG. 10A shows a front view of an outer portion assembly of the example container holder of FIG. 1.
Figure 10C:
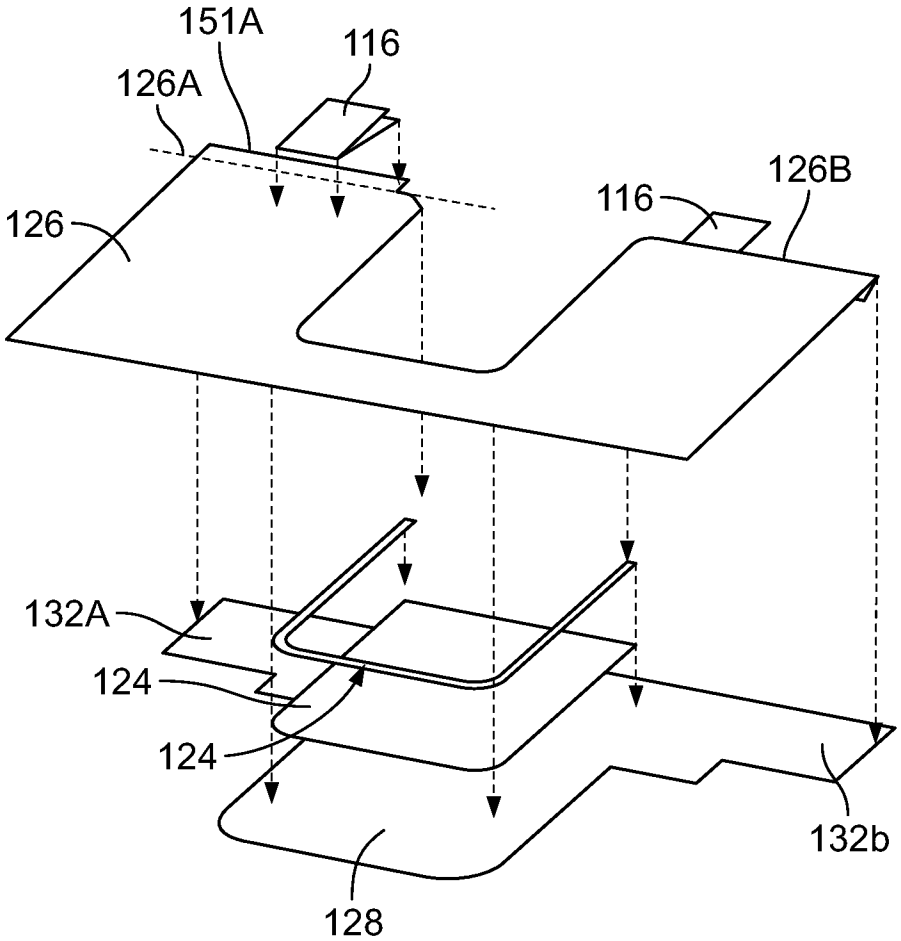
FIG. 10C shows a method of forming the example pocket assembly of FIG. 10B.

FIGS. 10A-10C illustrate the pocket 124 and an assembly method for securing the pocket 124 to the container holder 100. In one example, the pocket 124 can be secured to the container holder 100 by sandwiching the pocket 124 between a first reinforcement layer 126 and a second reinforcement layer 128. As shown in FIGS. 10A-10C, the first reinforcement layer 126 fits over the pocket 124 or stretch woven material. The first reinforcement layer 126 has a U-shaped cutout to receive the pocket 124. The first reinforcement layer 126 can also include the loops 116 for receiving carry strap 105. As shown in FIG. 10A, the loops 116 can be stitched to the first reinforcement layer 126 prior to the pocket 124 being sandwiched between the first reinforcement layer 126 and the second reinforcement layer 128. In this example, flanges 126A, 126B can be folded to form two folds 151A, 151B. The two folds 151A, 151B provide additional reinforcement for securing the loops 116 to the container holder. In this example, the folds 151A, 151B can be stitched with the loops 116 underneath each of the folds 151A, 151B.

A TPU material 130 can be secured to the pocket 124 through RF welding (i.e. radio-frequency welding, dielectric welding, high-frequency welding) or adhesives. The TPU material can provide a binder along the pocket to encapsulate the edges of the pocket 124 to provide a clean edging around the pocket. In one example, the stretch woven material forming the pocket 124 can be fastened to the second reinforcement layer 128 by stitching. Once the stretch woven material forming the pocket 124 is attached to the second reinforcement layer 128, the first reinforcement layer 126 can be attached to the second reinforcement layer 128. Also, the second reinforcement layer 128 may include a pair of arm portions 132A, 132B. And when assembled to the container holder 100, the pair of arm portions 132A, 132B can wrap around the container holder and specifically form part of the first portion 106.

FIGS. 9, 15A-15C, and 16A-16B illustrate the internal components of the container holder 100. Referring to FIG. 9, a cross-sectional view of the example container holder 100, a compression molded base 138 can be included, and the liner 108 can extend along the base 138. And in this example a second piece of material 108B forming the inner liner 108 can be included at the base. The second piece of material 108B can be stitched to an upper piece of material 108A to form the inner liner 108. The outer shell 110 can be folded over itself and the inner liner 108 can be folded over itself and stitching 139 can secure the inner liner 108 to the outer shell 110.

In other examples, a TPU film (not shown) can be stitched to the liner 108 at the top portion of the liner 108. And the material forming the outer shell 110 at a top portion can be folded over liner 108 and the TPU film, and the top portion of the outer shell can be folded over itself before being secured to the top portion of the inner liner 108 and the TPU film. In one example, the outer shell 110 can be welded to the top portion of the inner liner 108 and the TPU film by RF, sonic, or heat welding or by pressing or adhesives. But other securing methods are also contemplated such as stitching discussed herein.

Figures 15A, 15B, 15C:
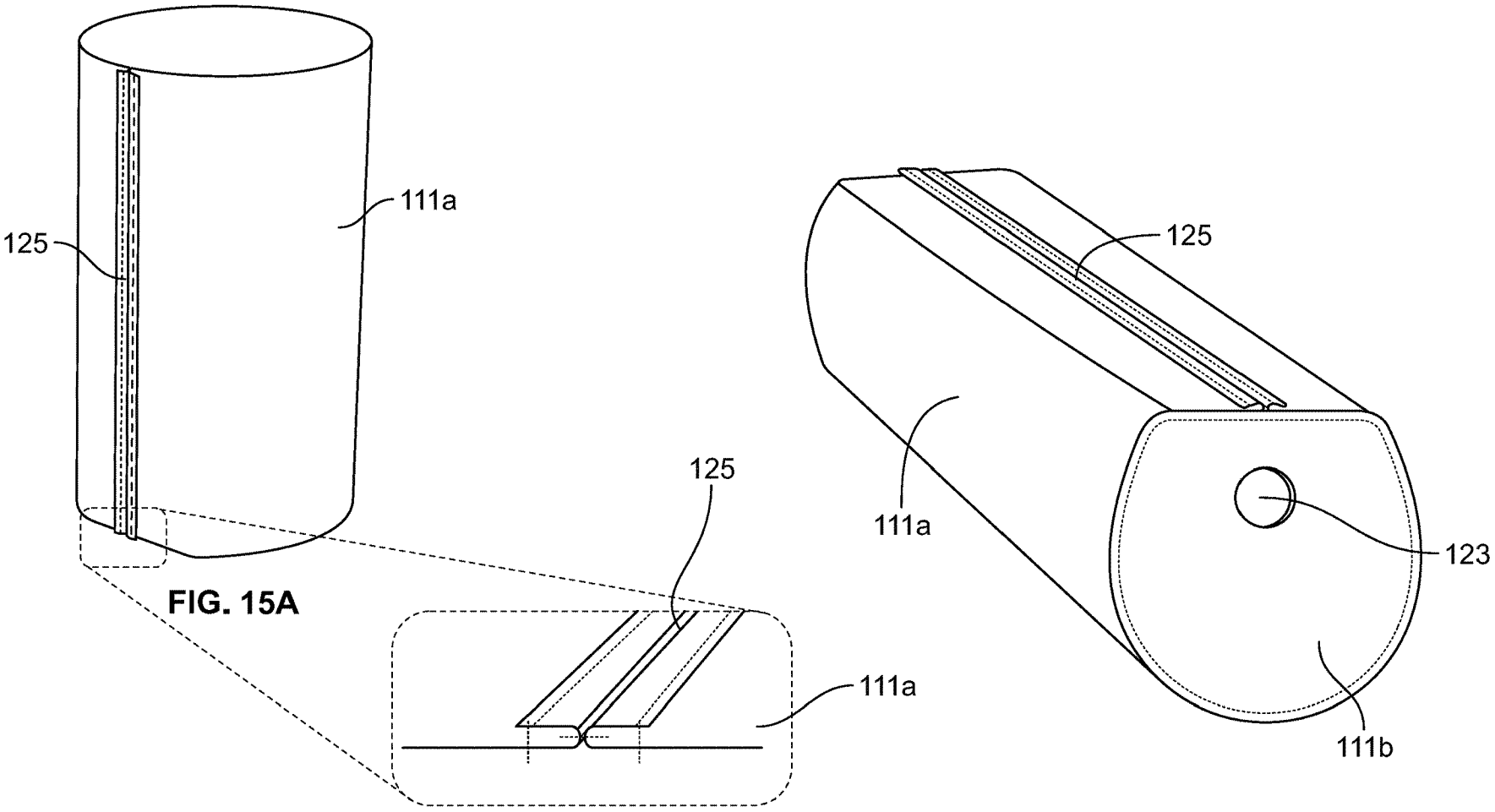
FIG. 15A shows a side-perspective view of an example intermediate layer that can be used in conjunction with a container holder.
FIG. 15B shows a method of assembling the intermediate layer of FIG. 15A.
FIG. 15C shows a bottom perspective view of the intermediate layer of FIG. 15A.

Turning now to FIGS. 15A-15C, the intermediate layer 111 by itself is shown. As is shown in FIGS. 15A-15C, the intermediate layer 111 can be formed of a first sheet of material 111*a* that is rolled into the shape of a cylinder and a second sheet of material 111*b* to form the base. In one example, the first sheet of material 111*a* and the second sheet of material 111*b* can be formed of closed cell foam, open cell foam or other materials with like properties. In one example, the first sheet of material 111*a* can be folded over on its first edge and its second edge and secured by stitching and each of the stitched edges can be stitched together forming a seam 125 to secure the first sheet of material 111*a* in a cylindrical shape. The seam 125 may also serve as a vent for air so the container may easily be placed within and removed from the cavity 103. To accomplish the venting, in one example, the seam 125 can be aligned with the series of venting holes on the reinforcement layer 117 on the outer shell 110. The seam can be formed by lock stitch, adhesives or by molding (injection or forming). Next the second sheet of material 111*b* can be added to the cylindrical shape formed by the first sheet of material 111*a*, and in this example can be stitched to the bottom of the cylinder formed by the first sheet of material 111*a*. Also the intermediate base layer 111*b* can be formed with an intermediate base layer vent or opening 123. The intermediate base layer vent 123 can be configured to receive a rivet or grommet 127 as discussed below. And in this case the intermediate base layer vent allows air within the cavity to escape to limit the amount of suction force within the cavity when the container is placed within or removed from the cavity 103.

Figure 16B:
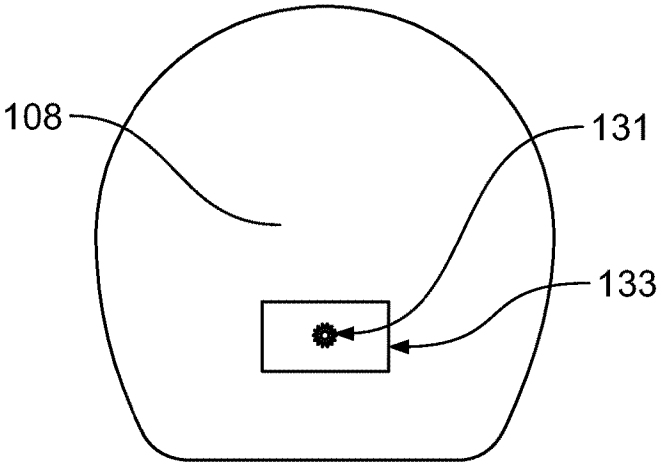
FIG. 16B shows a bottom view of the inner liner of FIG. 16A.
Figure 16A:
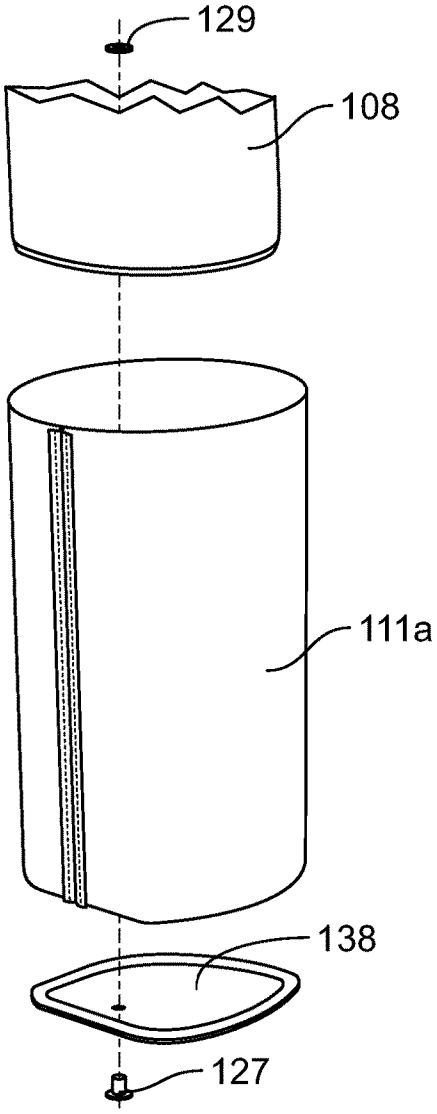
FIG. 16A shows a method of assembling a base to an intermediate layer and an inner liner.

FIG. 16A shows an exploded view of an example container holder 100 without the outer shell. In this example, a fastener, such as a bolt, rivet, or grommet 127, having a through-hole can be provided. The bolt or rivet 127 can extend through the compression molded base 138, which can be formed of a TPU, the intermediate layer 111, and the inner liner 108. Also a grommet 129 can receive the bolt or rivet 127 and sit on top of the inner liner 108 within the cavity of the container holder 100. In this way the rivet 127 and the grommet 129 can secure the compression molded base 138, the intermediate layer 111, and the inner liner 108 together. Additionally, as shown in FIG. 16B, a series of webbing 133 and an eyelet stitch 131 can be added to the bottom of the inner liner 108 to reinforce the grommet 129 and rivet 127 extending through the inner liner 108. Because the rivet 127 has a through hole and extends through the compression molded base 138, the intermediate layer 111, and the inner liner 108, it also provides a vent for the cavity 103 to the outside. For example, the rivet 127 may vent air, moisture, water, or any type of fluids to the outside.

In one example, the intermediate layer 111 can have a uniform thickness throughout the intermediate layer 111. In one example, the thickness of the intermediate layer can be 2 mm to 10 mm. And in one specific example, the foam may be 2 mm throughout the entire intermediate layer. This also creates a uniform wall thickness for the entire container holder 100. This example container can accommodate a single sized container.

In another alternative example, the example container holder may be configured to accommodate different sized containers in its construction. For example, the second portion 104 can be formed to be compressible so that the inner wall of the second portion biases the second portion 104 into the container. In one example, a compressible foam can be included as the foam layer in the second portion such that the second portion foam is more compressible than the foam in the first portion. In one example, the second portion 104 foam may be equal to or greater than 50% compressible. And in another example, second portion foam can be equal to or greater than 85% compressible. Also the foam material in the first portion can be formed thinner than the foam material in the second portion.

Also the compressible foam can be included as the foam layer in the second portion 104 such that the second portion 104 foam is more compressible than the foam in the first portion 106. In this example, the foam material in the first portion 106 can be formed thinner than the foam material in the second portion 104. But it is also contemplated that the foam in both portions can be equally compressible. In one example, the second portion 104 can include a polyethylene sheet of material for reinforcement of the second portion 104. This example can accommodate different sized containers of different diameters by providing a degree of compressibility to vary the size and shape of the container holder.

In another example, the intermediate layer of the first portion 106 can have a first thickness and the intermediate layer of the second portion 104 can have a second thickness. And the second thickness of the second portion 104 can be greater than the first thickness. In one example, the first thickness can be 1 mm to 5 mm and the second thickness can be 8 mm to 15 mm. In one specific example, the first thickness can be 2 mm, and the second thickness can be 10 mm. In this example, the overall wall thickness of the second portion 104 is greater than the overall wall thickness of the first portion 106.

In one example, a container holder may include an inner liner, an outer shell, and an intermediate layer in between the inner liner and the outer shell. The inner liner may provide an inner wall, where the inner wall defines a cavity for receiving a container. The container holder may include a first portion and a second portion where the first portion follows a curved profile and the second portion follows a flat profile such that a cross-section of the container holder follows a D-shape. A pocket may be located on the outer shell and on the first portion. And the second portion may include a series of openings extending through the outer shell to vent the cavity to an outside. The container holder may also include a bottom and the bottom may include an opening for venting the cavity of the container holder. And the inner liner can be formed of a stretch woven material, the intermediate can be formed of a polyethylene material, and the outer shell can be formed of a TPU coated fabric layer or the like.

In another example, a series of loops may cover the series of openings on the second portion. And the outer shell of the second portion can also include a slot and a pair of tabs. The series of loops may be attached to the pair of tabs and a reinforcement layer may cover the slot formed in the outer shell. Also the reinforcement layer may include the series of openings to vent the cavity to an outside. The series of loops may be placed onto a strip of material and the strip of material may be sewn to the tabs and the reinforcement layer to form the series of loops.

In another example a pair of clips may be mounted to the series of loops. The clips may each comprise a lock base and a clamping plate. And the clamping plate can rotate on the lock base by a hinge. The clamping plate can include a projection that is configured to be received in an opening located on the clamping plate. The clamping plate may also include at least one flange for engaging the projection to latch the clamping plate onto the lock base.

In another example, the second portion may be formed thicker than the first portion to accommodate different sized containers. The intermediate layer at the second portion can be formed compressible. The intermediate layer at the second portion can be formed more compressible than the intermediate layer at the first portion. In one example, the intermediate layer at the second portion may be equal to or greater than 50% compressible. In another example, the intermediate layer at the second portion may be equal to or greater than 85% compressible. In one example, the intermediate layer at the second portion can be a foam material and the intermediate layer at the first portion can be a foam material. For example, the intermediate layer at the first portion and the intermediate layer at the second portion may be an opened cell foam material. In an example, the second portion of the intermediate layer may include a polyethylene sheet of material.

In another example, the pocket may be formed of a stretch woven material that is sandwiched between a first reinforcement layer and a second reinforcement layer. And the first reinforcement layer can fit over the stretch woven material and may have a U-shaped cutout. Also the stretch woven material may be fastened to the second reinforcement layer. Also the second reinforcement layer may include a pair of arm portions and the pair of arm portions can wrap around the first portion. A pair of loops may be stitched to the first reinforcement layer and the second reinforcement layer, and the pair of loops may be configured to receive a carry strap.

In another example, the base can be a compression molded base and a bottom vent extending through the compression molded base, the intermediate layer, and the inner liner wherein the vent allows internal air to escape from the cavity when a user places a container into the cavity and air to enter the cavity when a user removes a container from the cavity.

In another example, a container holder can include an inner liner, an outer shell, and an intermediate layer in between the inner liner and the outer shell. The inner liner may include an inner wall, where the inner wall defines a cavity for receiving a container. The container holder may include a first portion and a second portion. The first portion can follow a curved profile and the second portion can follow a flat profile such that a cross-section of the container holder follows a D-shape. A pocket can be located on the outer shell and on the first portion. The second portion can have a series of openings extending through the outer shell to vent the cavity to an outside. A series of loops may cover the series of openings on the second portion and a pair of clips can be mounted to the series of loops. A compression molded base and a bottom vent can extend through the compression molded base, the intermediate layer, and the inner liner wherein the vent allows internal air to escape from the cavity when a user places a container into the cavity and air to enter the cavity when a user removes a container from the cavity.

In one example, the clips each comprise a lock base and a clamping plate. The clamping plate can rotate on the lock base by a hinge. The clamping plate can have a projection that is configured to be received in an opening located on the clamping plate. The clamping plate can also include at least one flange for engaging the projection to latch the clamping plate onto the lock base.

In one example, the outer shell of the second portion may include a slot and a pair of tabs. The series of loops can be attached to the pair of tabs and a reinforcement layer may cover the slot. The reinforcement layer may include the series of openings and the series of loops can be placed onto a strip of material. The strip of material may be sewn to the tabs and the reinforcement layer to form the series of loops.

In another example, a method of forming a container holder can include providing an inner liner, providing an outer shell by forming a first curved portion and a second flat portion and securing the first curved portion to the second flat portion. The first portion may be provided with a pocket for receiving items. The second portion may be provided with a series of loops and vents. Also the series of loops may conceal the series of vents. The method can also include placing a pocket on the outer shell, placing an intermediate layer between the inner liner and the outer shell, securing the inner liner to the outer shell where the inner liner defines a cavity for receiving a container, and securing a base to the outer shell, the base having an opening for air. In one example, the opening in the base can be formed by a fastener with a through hole extending through the fastener.

The method can also include forming a slot on the outer shell in the second portion and providing the slot with a pair of tabs, attaching the series of loops to the pair of tabs located on the second portion of the outer shell and attaching the series of loops to a reinforcement layer. The method can also include forming the series of loops with a strip of material and sewing the strip of material onto the strip of material, the tabs and the reinforcement layer to form the series of loops, and the method may also include forming the pocket of a stretch woven material and sandwiching the stretch woven material between a first reinforcement layer and a second reinforcement layer.

The present disclosure is disclosed above and in the accompanying drawings with reference to a variety of examples. The purpose served by the disclosure, however, is to provide examples of the various features and concepts related to the disclosure, not to limit the scope of the disclosure. One skilled in the relevant art will recognize that numerous variations and modifications may be made to the examples described above without departing from the scope of the present disclosure.

What is claimed is:

1. A container holder comprising:

an inner surface and an outer surface wherein the inner surface defines a cavity for receiving a container;

a pocket;

a front portion and a rear portion and wherein the front portion defines a curved portion and the rear portion defines a flat portion, the flat portion comprising vertically aligned loops configured for receiving clips, the clips configured to mount to the container holder and configured to mount the container holder to an object, and a reinforcement layer positioned behind the vertically aligned loops;

wherein the clips each comprise a lock base and a clamping plate wherein the clamping plate rotates on the lock base by a hinge, the lock base having a projection that is configured to extend into an opening located on the clamping plate and wherein the clamping plate further comprises at least one flange for engaging the projection to latch the clamping plate onto the lock base.

2. The container holder of claim 1 wherein the clamping plate comprises one or more elongated projections, which act as retention mechanisms configured to maintain the container holder in position along an object.

3. The container holder of claim 2 wherein the lock base is held onto the container holder with an arm extending from the lock base.

4. The container holder of claim 3 wherein the arm extends from the lock base above a gap in the lock base.

5. The container holder of claim 2 further comprising a pair of side loops and a carry strap and wherein the carry strap is adjustable and connects to the container holder through the side loops.

6. The container holder of claim 5 wherein the pair of side loops are attached to a second reinforcement layer.

7. The container holder of claim 6 wherein the pocket is formed of a stretch material.

8. The container holder of claim 7 wherein the pocket is attached to the second reinforcement layer and wherein the second reinforcement layer comprises a pair of arm portions that extend along the front portion.

9. The container holder of claim 8 wherein the arm portions extend to the pair of side loops.

10. The container holder of claim 1 wherein the pocket is configured to receive one or more of a smart phone, keys, or credit cards.

11. The container holder of claim 1 wherein the container holder defines a first height and the pocket defines a second height and wherein the second height is a majority of the first height.

12. The container holder of claim 1 wherein the at least one flange is spring loaded to retain the clamping plate in a closed position on the lock base.

13. A container holder comprising:

an inner surface and an outer surface wherein the inner surface defines a cavity for receiving a container;

a first portion of the container holder comprising a pocket and a pair of side loops configured for receiving a carry strap, wherein the first portion follows a curved profile;

a second portion of the container holder comprising vertically aligned loops, wherein the vertically aligned loops are configured for receiving a pair of clips configured to mount to the second portion and configured to mount the container holder to an object, and wherein the second portion follows a flat profile;

a first reinforcement layer positioned behind the vertically aligned loops; and a second reinforcement layer comprising a pair of arms positioned behind the pair of side loops and a central area positioned behind the pocket;

wherein the carry strap connects to the container holder through the side loops.

14. The container holder of claim 13 wherein the pair of clips each comprise a lock base and a clamping plate wherein the clamping plate rotates on the lock base by a hinge, the lock base having a projection that is configured to extend into an opening located on the clamping plate and wherein the clamping plate further comprises a pair of flanges actuatable by a user for engaging the projection to latch the clamping plate onto the lock base.

15. The container holder of claim 13 wherein the pocket is formed of a stretch material.

16. The container holder of claim 15 wherein the pocket is configured to receive one or more of a smart phone, keys, or credit cards.

17. The container holder of claim 13 wherein the container holder defines a first height and the pocket defines a second height and wherein the second height is a majority of the first height.

18. The container holder of claim 14 wherein the clamping plate comprises one or more elongated projections, which act as retention mechanisms configured to maintain the container holder in position along an object.

19. The container holder of claim 18 wherein the lock base is held onto the outer surface with an arm extending from the lock base.

20. The container holder of claim 19 wherein the arm extends from the lock base above a gap in the lock base.

21. The container holder of claim 14 wherein at least one flange of the pair of flanges is spring loaded to retain the clamping plate in a closed position on the lock base.

22. A container holder comprising:

an inner wall and an outer wall wherein the inner wall defines a cavity for receiving a container;

vertically aligned loops configured to receive a pair of clips configured to mount to the container holder and configured to retain the container holder to a surface, and a reinforcement layer positioned behind the vertically aligned loops;

wherein the pair of clips each comprise a lock base and a clamping plate wherein the clamping plate rotates on the lock base by a hinge, the lock base having a projection that is configured to extend into an opening located on the clamping plate and wherein the clamping plate further comprises at least one flange for engaging the projection to latch the clamping plate onto the lock base.

23. The container holder of claim 22 defining a first portion and a second portion and the first portion follows a curved profile and the second portion follows a flat profile.

24. The container holder of claim 23 wherein a pocket is located on the first portion.

25. The container holder of claim 24 further comprising a pair of side loops and a carry strap and wherein the carry strap connects to the container holder through the side loops.

26. The container holder of claim 25 wherein the container holder defines a first height and the pocket defines a second height and wherein the second height is a majority of the first height.

27. The container holder of claim 26 wherein the lock base is held onto the outer wall with an arm extending from the lock base and wherein the arm extends from the lock base above a gap in the lock base.

28. A container holder comprising:

an inner liner, an outer shell, and an intermediate layer in between the inner liner and the outer shell, the inner liner providing an inner wall, wherein the inner wall defines a cavity for receiving a container;

the container holder defining a first portion and a second portion and the first portion follows a curved profile and the second portion follows a flat profile such that a cross-section of the container holder follows a D-shape;

a pocket located on the outer shell and on the first portion;

the second portion having a series of vertically spaced openings extending through the outer shell to vent the cavity to an outside;

wherein a series of loops covers the series of vertically spaced openings on the second portion in order to conceal the series of vertically spaced openings and a pair of clips mounted to the series of loops;

wherein the pair of clips each comprise a lock base and a clamping plate wherein the clamping plate rotates on the lock base by a hinge, the lock base having a projection that is configured to be received in an opening located on the clamping plate and wherein the clamping plate further comprises at least one flange for engaging the projection to latch the clamping plate onto the lock base.

29. The container holder of claim 28 wherein the second portion is thicker than the first portion to accommodate different sized containers.

30. The container holder of claim 28 further comprising a compression molded base and a bottom vent extending through the compression molded base, the intermediate layer, and the inner liner, wherein the vent allows internal air to escape from the cavity when a user places a container into the cavity and allows air to enter the cavity when a user removes a container from the cavity.

31. A container holder comprising:

an inner liner, an outer shell, and an intermediate layer in between the inner liner and the outer shell, the inner liner providing an inner wall, wherein the inner wall defines a cavity for receiving a container;

the container holder defining a first portion and a second portion and the first portion follows a curved profile and the second portion follows a flat profile such that a cross-section of the container holder follows a D-shape;

a pocket located on the first portion of the outer shell;

the second portion having a series of vertically spaced openings extending through the outer shell to vent the cavity to an outside;

a series of loops covering the series of vertically spaced openings on the second portion in order to conceal the series of vertically spaced openings and a pair of clips mounted to the series of loops;

a base and a bottom vent extending through the base, the intermediate layer, and the inner liner, wherein the vent allows internal air to escape from the cavity when a user places a container into the cavity and air to enter the cavity when a user removes a container from the cavity;

wherein the pair of clips each comprise a lock base and a clamping plate wherein the clamping plate rotates on the lock base by a hinge, the lock base having a projection that is configured to be received in an opening located on the clamping plate and wherein the clamping plate further comprises a pair of flanges actuable by a user for engaging the projection to latch the clamping plate onto the lock base.

* * * * *